US007090440B1

(12) United States Patent
Short

(10) Patent No.: US 7,090,440 B1
(45) Date of Patent: Aug. 15, 2006

(54) METHOD AND DEVICE FOR STABILIZING SLOPES

(76) Inventor: Richard Dovovan Short, 4125 Blackhawk Plaza Cir., Blackhawk, CA (US) 94506

( * ) Notice: Subject to any disclaimer, the term of this patent is extended or adjusted under 35 U.S.C. 154(b) by 0 days.

(21) Appl. No.: 11/097,802

(22) Filed: Mar. 31, 2005

(51) Int. Cl.
*E02D 5/80* (2006.01)
*E02D 17/20* (2006.01)

(52) U.S. Cl. ..... 405/302.4; 405/259.1; 405/231; 52/156

(58) Field of Classification Search ..... 405/258.1, 405/259.1, 284, 285, 286, 252, 231, 244; 256/DIG. 5, 65.02, 65.14; 52/155, 156, 52/165

See application file for complete search history.

(56) References Cited

U.S. PATENT DOCUMENTS

| | | | | |
|---|---|---|---|---|
| 1,073,278 | A | 9/1913 | Mosher | |
| 1,109,020 | A | 9/1914 | Skiff et al. | |
| 1,408,332 | A | 2/1922 | Zimmerman | |
| 1,433,621 | A | 10/1922 | Hutton | |
| 2,880,588 | A | 4/1959 | Moore | |
| 3,412,561 | A | 11/1968 | Reid | |
| 4,252,472 | A * | 2/1981 | Moraly | 405/244 |
| 4,530,190 | A | 7/1985 | Goodman | |
| 4,615,156 | A * | 10/1986 | Deike | 52/98 |
| D334,121 | S | 3/1993 | Van Handel, III | |
| 5,797,706 | A | 8/1998 | Segrestin et al. | |
| 6,659,686 | B1 | 12/2003 | Veazey | |
| 6,666,625 | B1 | 12/2003 | Thornton | |
| 2005/0042038 | A1 * | 2/2005 | Irvine | 405/276 |

FOREIGN PATENT DOCUMENTS

| | | |
|---|---|---|
| DE | 4226067 | 5/1993 |
| JP | 57071931 | 5/1982 |

OTHER PUBLICATIONS

Rogers, "Recent Developments in landslide mitigation techniques." Geo. Soc. of America, Reviews in Engineering Geo., vol. IX 1992, 95-118.

Aubeny, "Shallow Slides in compacted High Plasticity Clay Slopes" Journal of Geotechnical+Geoenvirn. Eng., ASCE, Jul. 2004, pp. 717-727.

Cho, "Evalutation of Surficial Stability for Homogenous Slopes Considering Rainfall Characteristics", Journ. Geotech+Geoenvirn. Sep. 2002, pp. 756-763.

Collins, "Stability Analyses of Rainfall Induced Landslides", Journ. Geotech.+Geoenviron. Eng., ASCE, Apr. 2004, pp. 362-372.

(Continued)

*Primary Examiner*—Thomas B. Will
*Assistant Examiner*—Tara L. Mayo
(74) *Attorney, Agent, or Firm*—Sharon J. Adams

(57) ABSTRACT

A method and device for stabilizing slopes that are at or near failure preferably due to a shallow, translational slides. Once a target slope has been identified, a plurality of plate piles is inserted into the entire at-risk slope to stabilize the slope. The plate piles preferably consist of a steel plate attached to an angle. The plate piles are inserted below the soil surface, with the pile extending into the bedrock, preferably in a diamond-shaped lattice pattern over the entire slope.

7 Claims, 8 Drawing Sheets

OTHER PUBLICATIONS

Iverson, "Landslide triggering by rain infiltration", Water Resources Research, vol. 36, No. 7, pp. 1897-1910, Jul. 2000.

Ito, "Design Method for Stabilizing Piles Against Landslide-One Row of Piles", Soils & Foundations, Japanese Society Soil Mech+Found. Eng. vol. 21, No. 1, Mar. 1981, pp. 21-37.

Ito, "Extended Design Method for Multi-Row Stabilizing Piles Against Landslide" Soils +Foundations, Japanese Society Soil Mech+Found. Eng. vol. 22 No. 1 Mar. 1982, pp. 1-13.

* cited by examiner

METHOD AND DEVICE FOR STABILIZING SLOPES

CROSS REFERENCE TO RELATED APPLICATION

Not Applicable.

FEDERAL SPONSORSHIP

Not Applicable.

BACKGROUND

Shallow, colluvial landslides are a common occurrence in many areas. This type of slope failure requires preventative action for both stability and aesthetic reasons, especially around existing homes. Many of existing methods of landslide mitigation and slope stabilization are aimed at stabilizing large slopes with large project volumes and costs. An effective, relatively small-scale method for stabilizing shallower, colluvial hillsides that are at or near failure is needed.

Research on mitigation techniques for shallow, colluvial landslides has seen some interest from the geotechnical community in the past 20 years, although most research has been performed on the predictive analysis of these types of slides (e.g. Aubeny and Lytton, 2004; Cho and Lee, 2002; Collins and Znidarcic, 2004; Iverson, 2000). While predictive analysis techniques are an important aspect of understanding slope stability behavior, they do not always assist communities faced with impending landslides. Instead, a method of preventing or arresting the movement of the slope mass is needed.

Existing methods of landslide mitigation have been summarized by Rogers (1992). They include excavation and recompaction, conventional retention structures, subdrainage, soil reinforcement using geomembranes and geosynthetics, mechanically stabilized embankments, and combination mechanically stabilized retention structures.

Unfortunately, most of these mitigation options are not applicable to shallow translational slides, mainly due to economic considerations. Retention structures, soil reinforcement options, mechanically stabilized embankments, and combination structures all require large volumes of earthworks in addition to comparatively expensive and time consuming installation methods. These techniques require excessive effort and time that is not warranted when mitigating shallow landslides that are small in area, on the order of only several tens of square yards. For these types of slides, only excavation and subdrainage techniques are applicable. However, these techniques require a substantial on-site and slope renovating presence. The present invention minimizes the need for large machinery and thereby allows slopes stabilization behind existing homes, and in other areas with limited access. Further, the method may be rapidly deployed so that slides may be prevented prior to full mobilization of the slide mass.

Others, such as Ito et al. (1981, 1982), have addressed rotational landslides. These deep landslides have been mitigated with extremely long (25 to 100 feet) columns (piles) placed in a portion of the potential slide area, generally at the toe of the slope to lock down the base of the potential slide. However, these long, heavy piles are inappropriate for shallow, translational slides. The present invention allows for locking down the entire potential slide area by placing relatively small, lightweight plate piles throughout the entire potential slide area.

Patents have issued describing some of the above-mentioned techniques. Devices and techniques for large scale slope stabilization are described in U.S. Pat. No. 2,880,588 issued to Moore, U.S. Pat. No. 5,797,706 issued to Segrestin et al., German patent number DE 4226067 issued to Hermann, and Japanese patent number JP 57071931 issued to Yoshihisa. These large-scale retaining walls require the use of heavy equipment, and are unsuitable for stabilizing smaller, less accessible slopes.

Other patents deal with stabilizing soil that is adjacent to water; for example U.S. Pat. No. 1,073,278 issued to Mosher, U.S. Pat. No. 3,412,561 issued to Reid, and U.S. Pat. No. 6,659,686 issued to Veazey. However, these patents do not specifically address slope stabilization of colluvial, sloping soil masses.

Still other patents describe the use of posts or anchors. See e.g., U.S. Pat. No. 1,408,332 issued to Zimmerman, U.S. Pat. No. 1,433,621 issued to Hutton, U.S. Pat. No. 4,530,190 issued to Goodman, U.S. Pat. No. 1,109,020 issued to Skiff et al., U.S. Pat. No. 6,666,625 issued to Thornton, and D334,121 issued to Van Handel III. These patents all assume that the piles will be used in conjunction with fencing. None of these patents teach the technique of placing stabilizing plate piles in a manner to prevent or reduce shallow colluvial landslides.

SUMMARY OF THE INVENTION

The present invention consists of identifying a target slope that is at or near failure with a potential landslide depth of two to five feet. Once the area of the potential landslide is determined, numerous plate piles are installed in a diamond-shaped lattice pattern over the entire target area to stabilize the hillside.

The plate piles consist of a steel plate preferably sized two feet by one foot by three-eights inch thick attached to a preferably six foot long steel pile 12. This allows a human to transport and handle the plate piles without the need for large equipment. Each plate pile may have one or more holes in the plate to allow the plates to be connected via a cable. Pile 12 may be either a pole or preferably an angle.

The plate piles are driven through the colluvium and into the subsurface bedrock. Once inserted, the plate piles are below the soil surface and are not visible, thus preserving the aesthetic appearance of the slope. The collective effect of the numerous plate piles, and the diamond-shaped lattice pattern of insertion reduces or eliminates soil movement. The plate piles stabilize the failing slope by inducing soil arching between adjacent piles and consequently resisting the gravitational forces that are driving the soil downslope. The result is to prevent soil movements caused by shear failure of the soils located immediately above the bedrock interface.

DETAILED DESCRIPTION OF THE INVENTION

The method may be used with clay, silt, sand or gravel soils, however, it is preferably used with clay or silt soil. These soil types are particularly susceptible to slides and are sufficiently soft enough to allow insertion of the plate piles 10.

Figure 7:
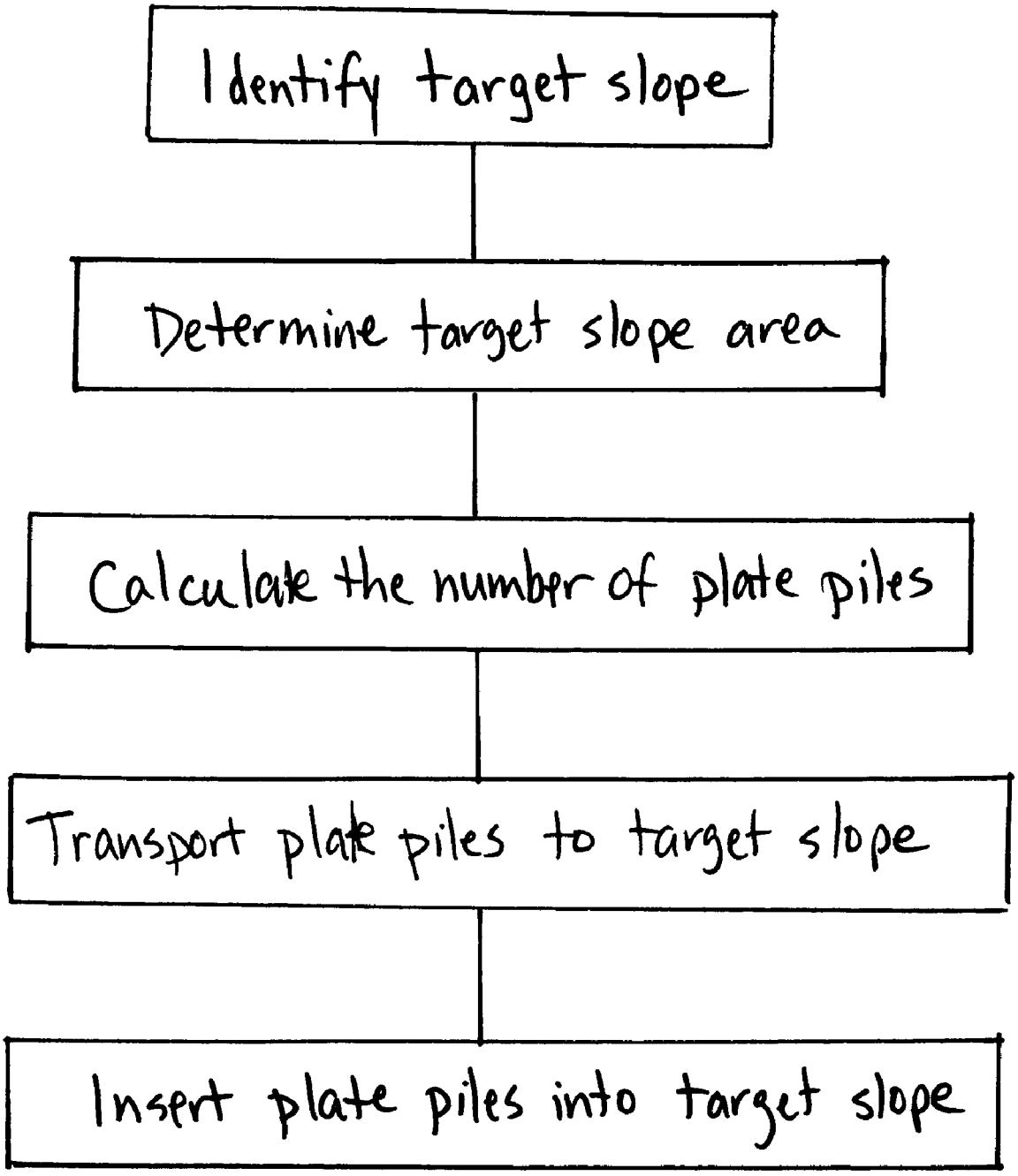
FIG. 7 is a flow chart of the method of the invention.

As shown in FIG. 7, the first step of the method of the invention is to identify a target slope. A target slope is a slope that is close to failing, or has already failed.

Slopes that have the potential to fail typically have certain physical characteristics. For example, once a slide has occurred the soil adjacent to the slide is at risk for failure, and may be stabilized using this method. Other slopes that are near failure may be identified though observing a characteristic toe below a hollow indicating that soil is creeping down a slope, the appearance of hummocks, or ground cracking and fissures near the crest of the slope.

Landslides are frequently caused by rain. Infiltrating water reduces the effective stress and consequently the frictional component of shear strength of the soil. When the gravitational forces overcome the shear strength of the soil, failure occurs. In addition, the soil may absorb water during rain and swells, pushing in all directions. The swollen soil particles encounter greater resistance against the underlying bedrock, and therefore tend to move upwards. In addition, gravity induces the soil particles to move down the slope. When the soil dries, these soil movements can result in splits and deep cracks. When it rains again, the rain seeps in and saturates the soil at depth, causing a slide. Even if this action does not result in a full-fledged slide, the result may be soil creep, where the soil moves down the slope over time. Thus, soil cracking is another indication of a potential slide.

The method also may be used on slopes that have already failed, or slopes that are experiencing soil movement or soil creep. These slopes may be immediately stabilized to prevent further soil movement. Soil creep often precedes full-blown landslides. Once soil creep has begun, it may be possible to rapidly deploy the method to prevent further soil movement. Similarly, if the slope failure is due to rain the slope may be stabilized using the method once the rain has stopped.

Most landslides occur on land typically having a slope inclination of approximately two horizontal to one vertical (26.6° slope angle). Landslides do not typically occur on very steep slopes, where the slope inclination is greater than one horizontal to one vertical, because the slope is too steep for the soil to adhere. Similarly, landslides do not typically occur where the slope inclination is less than three horizontal to one vertical because soil is more resistant to moving on these flatter slopes.

The method may be used in any variety of slope and soil conditions, however, the method is particularly useful for either potential or existing translational slides when (i) the slope inclination is between one horizontal to one vertical and three horizontal to one vertical; (ii) there are between two and five feet of colluvium overlying bedrock; and (iii) the shear surface occurs at the colluvial-bedrock interface.

Once a failed or failing slope has been identified, the next step, as shown in FIG. 7, is to determine the area of the target slope by determining the size of the potential or actual slide area. Persons skilled in dealing with slides frequently can accurately estimate the target slope area through simple observation and estimation. Alternatively, the target slope area can be measured.

Once the area of the target slope is determined the next step in the method, as shown in FIG. 7, is to calculate the number of plate piles 10 needed to stabilize the entire target slope area. Plate piles 10 must be driven into the entire target slope to lock down the target slope.

Figure 3:
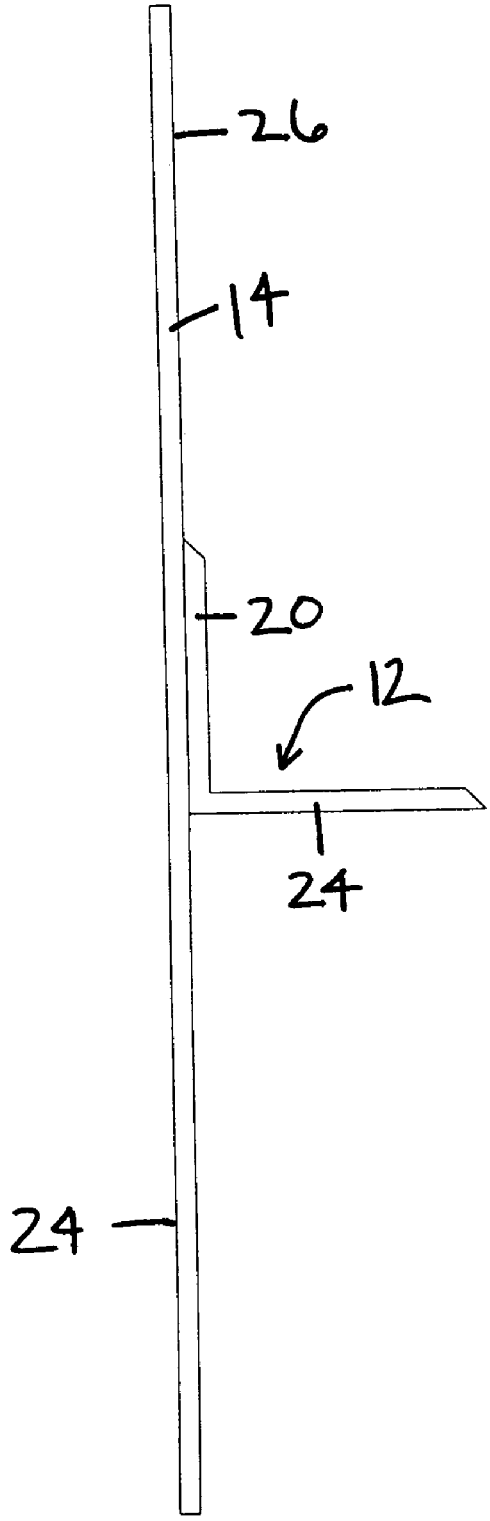
FIG. 3 is a top view of a single plate pile.
Figure 4:
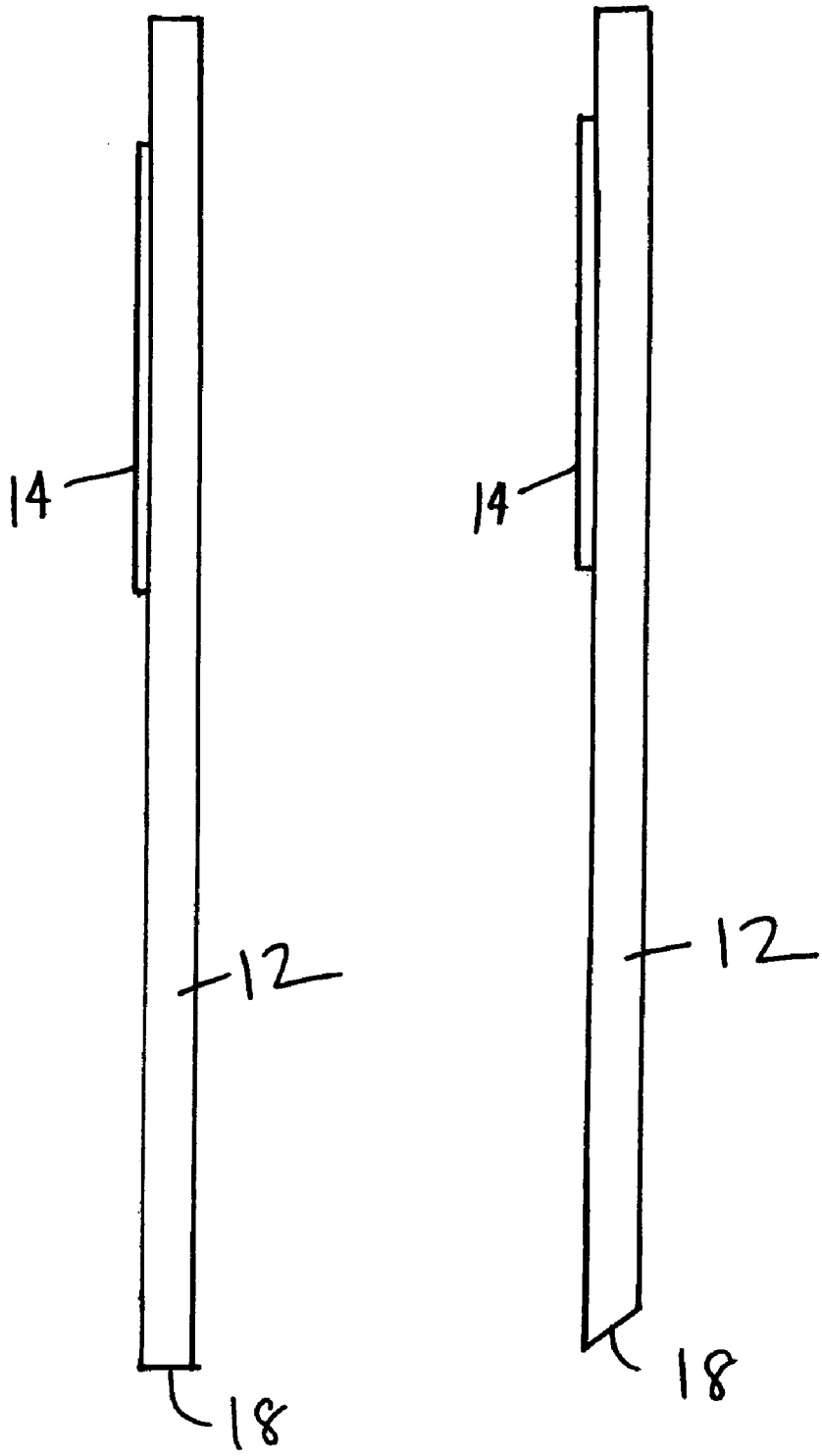
FIG. 4 is a side view of two plate piles.
Figure 5:
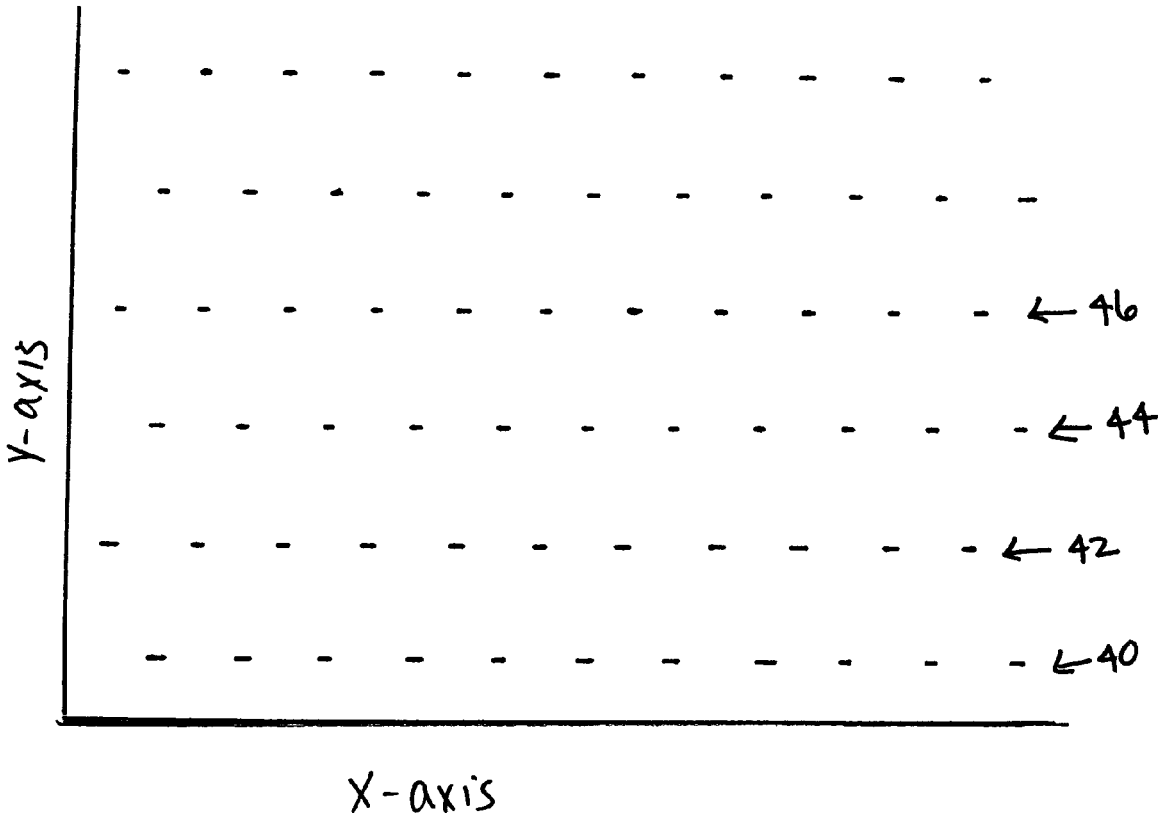
FIG. 5 is a plan view showing the placement of a plurality of plate piles on a slope in a diamond shaped lattice pattern.

As shown in FIG. 5, a plurality of plate piles 10 are inserted in a diamond-shaped lattice pattern over the target slope. Each plate pile 10 is preferably made from ⅜" steel, although any rigid material that is stable over the project lifetime may be used. Each plate pile 10 consists of a pile 12 and a plate 14. Pile 12 is preferably an angle, as shown in FIGS. 3 and 4. Piles 12 are preferably six feet long, although the size may be increased or decreased to accommodate different slide depths. The six-foot length is preferred because it is long enough to allow plate pile 10 to be securely placed in the bedrock 30, while also permitting a single worker to manipulate plate pile 10. The angle shape of pile 12 is preferred because an angle has a higher bending resistance, which results in an increase in the resistance to the gravitational pressure pushing soil down the slope. The bottom edge 18 of pile 12 will be driven into the ground, and may be angled or flat, as shown in FIG. 4. FIG. 3 shows that pile 12 is an angle and contains two planes, a front plane 20 and a side plane 22 placed at right angles to each other.

Plate 14 contains a front surface 24 and a rear surface 26. As shown in FIG. 3, the front plane 20 of pile 12 is permanently attached to the rear surface 26 of plate 14, preferably through welding or bolting.

Figure 1:
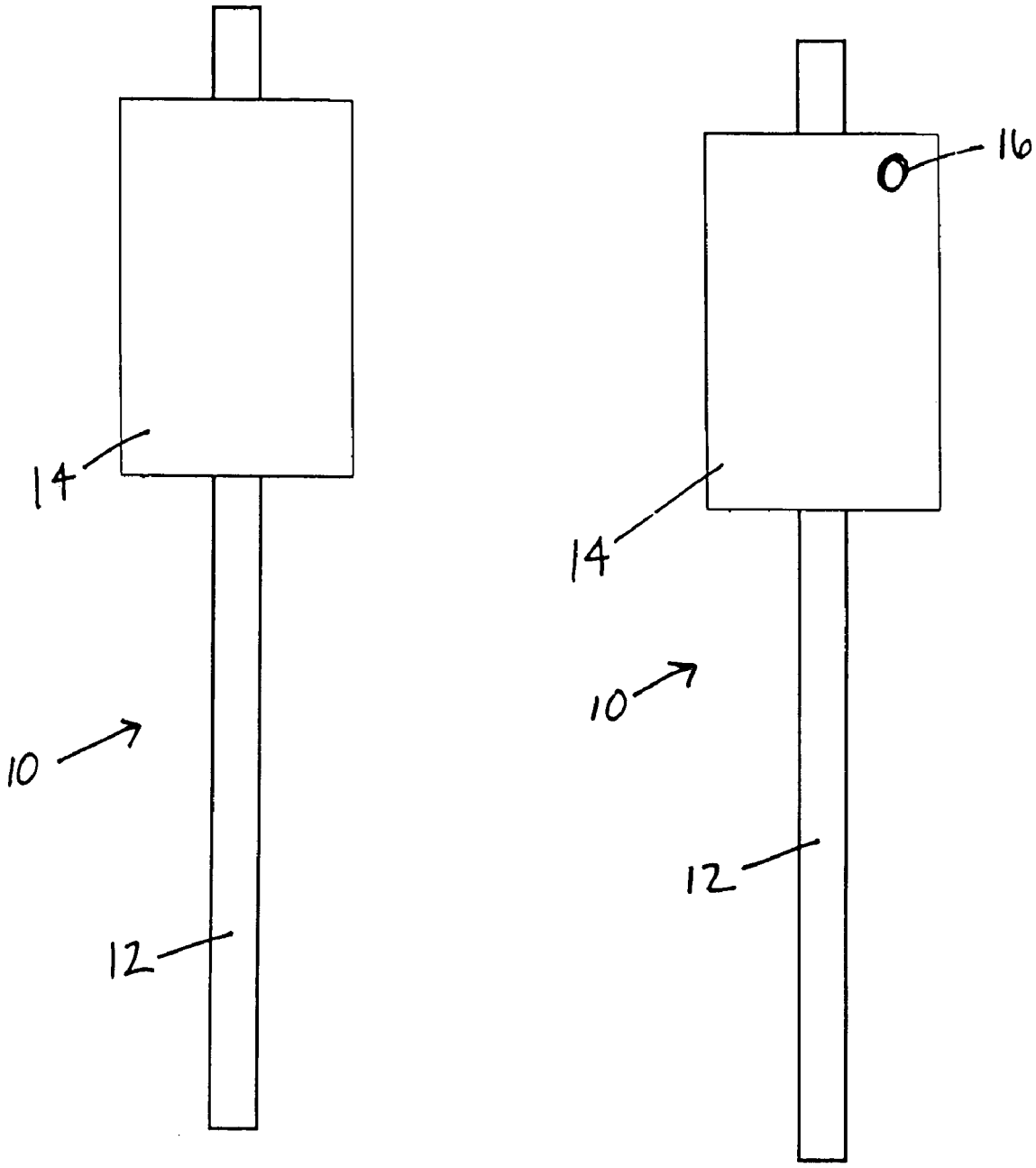
FIG. 1 is a front view of one embodiment of two plate piles, one with a hole and one without a hole.
Figure 2:
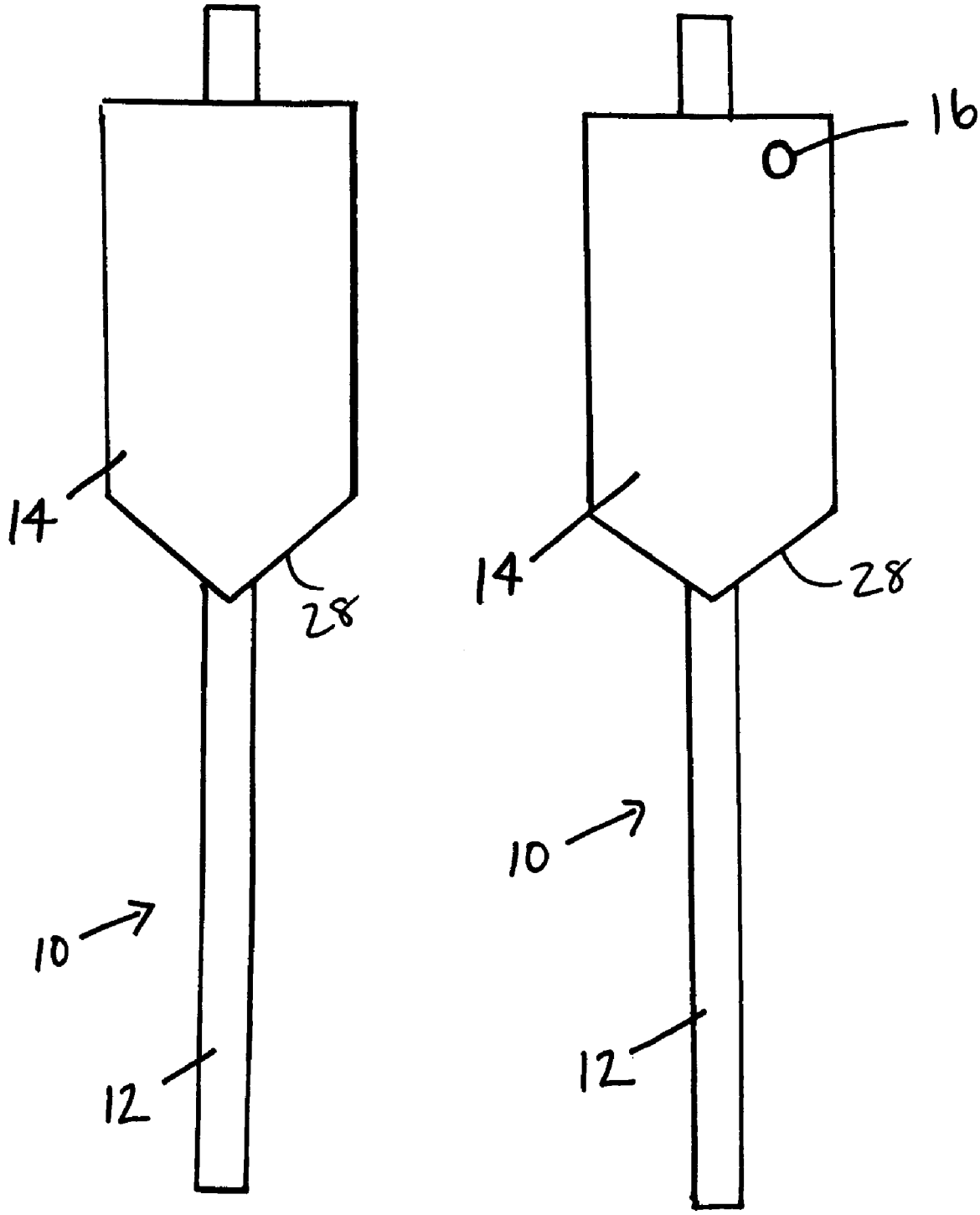
FIG. 2 is a front view of another embodiment of two plate piles, one with a hole and one without a hole.

Plate 14 may be essentially any shape that has a surface area of approximately two square feet. In the preferred embodiment, plate 14 is a rectangular shape, as shown in FIG. 1, with a width of one foot. A pentahedron plate embodiment is shown in FIG. 2. In the pentahedron embodiment, plate 14 has an angled edge 28 directed toward the ground to assist is driving the pile into the ground.

Figure 8:
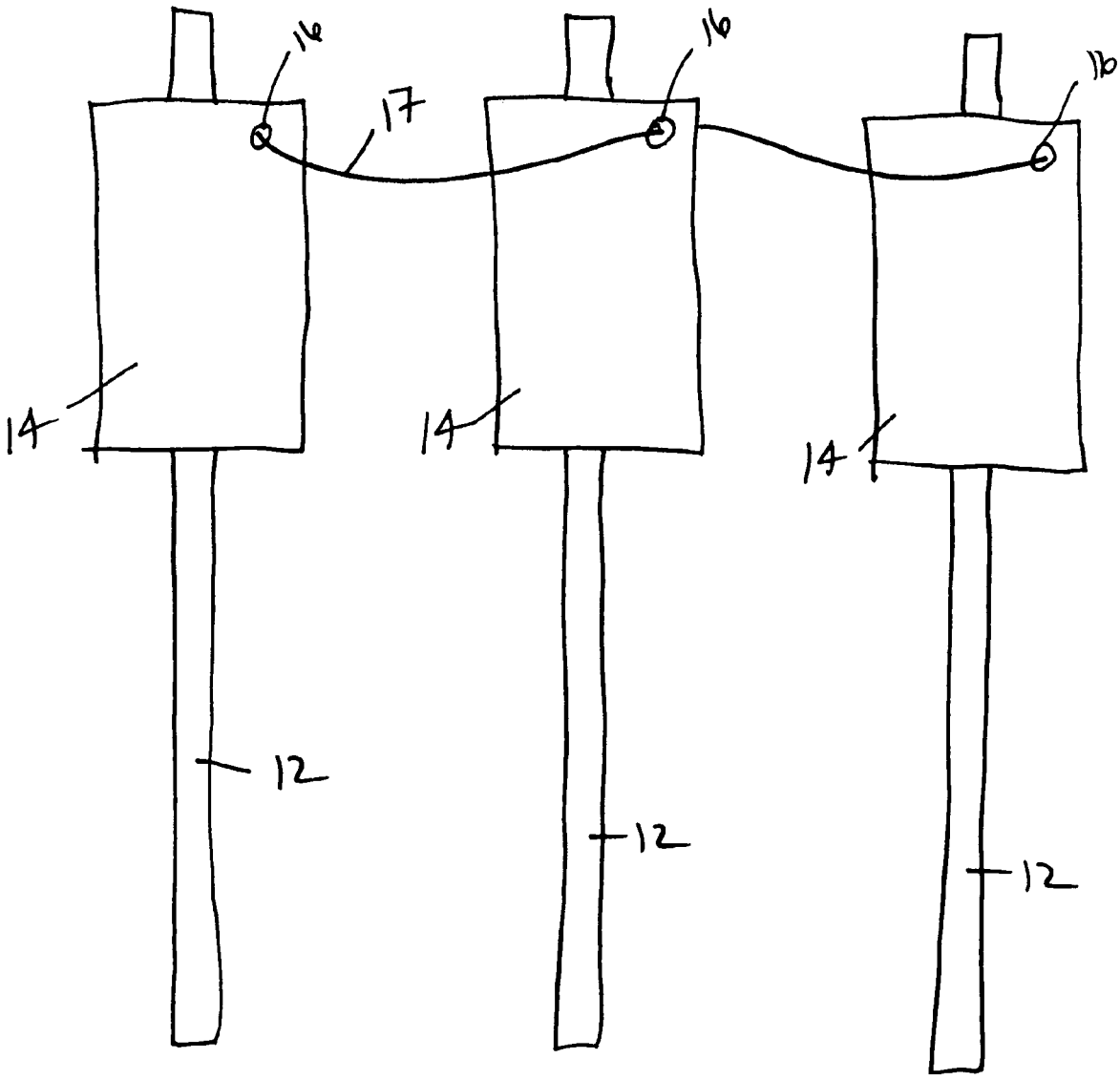
FIG. 8 is a front view of a plurality of plate piles connected by a cable.

FIGS. 1 and 2 show that both rectangular plate 14 and pentahedron plate 14 with angled edge 28 may optionally contain one or more holes 16. Cable 17 may optionally be threaded through hole 16 in a plurality of plate piles 10, as shown in FIG. 5B. Threading cable 17 through hole 16 of each plate pile 10, as shown in FIG. 8, will increase the lateral strength of the plurality of plate piles 10 and may provide additional slope stabilization, if needed. Alternatively, hole 16 may be used to ease removal of plate piles 10, if needed.

Figure 6:
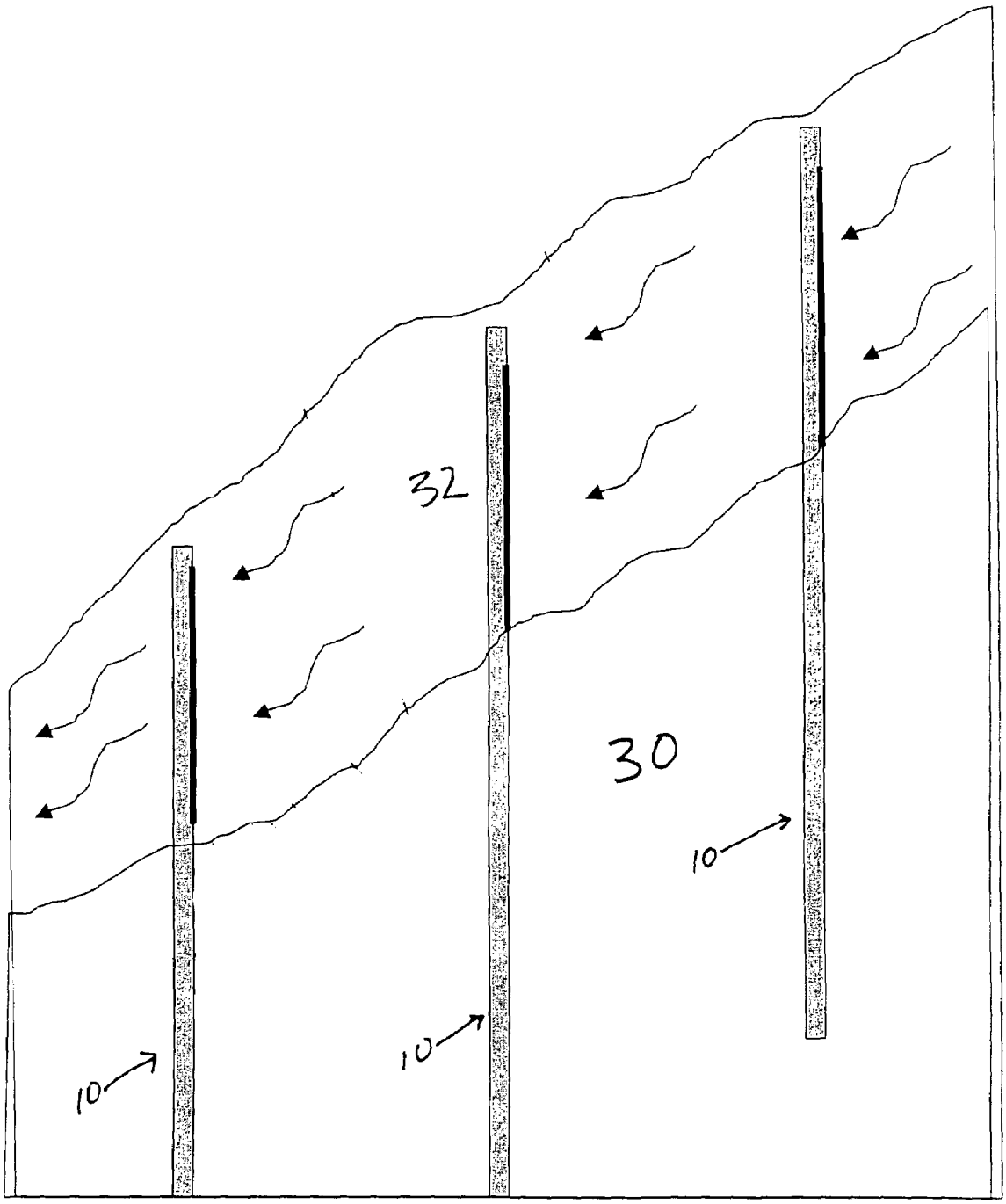
FIG. 6 is a cross-sectional view of the placement of a plurality of plate piles on a slope.

FIG. 6 is a cross-sectional view showing the placement of a plurality of plate piles 10 into a potential or actual landslide. Pile 12 is driven through the soil 32 until plate pile 10 is approximately six inches below the ground surface. The bottom of pile 12 is preferably driven three feet into bedrock 30, although more or less of pile 12 may actually be driven into bedrock 30.

Plate piles 10 are positioned to induce arching and resist the force of gravity that is attempting to move soil down the slope between plate piles 10. As shown in FIG. 5 the preferred placement to induce arching and stabilize the soil is to place plate piles 10 in a diamond-shaped lattice pattern on the target slope.

The plate piles are inserted in the intersection points of the lines of an imagined diamond-shaped lattice so that any given row of plate piles is offset from the previous and subsequent row of plate piles. In the diamond-shaped lattice pattern a first row 40 of plate piles 10 is preferably inserted in a horizontal line along the x-axis of the target slope, approximately four feet center-to-center. Thus, if using one-foot wide plates 14 there will be a three-foot space between plates 14. A second row 42 of plate piles 10 is preferably inserted approximately 10 feet from the first row on the y-axis. Each plate pile in the second row is four feet center-to-center on the x-axis. The second row may be either up or down the target slope from the first row along the y-axis. Plate piles 10 in the second row are not inserted directly behind plate piles 10 in the first row. Instead, the second-row plate piles 10 are offset from the first-row plates piles 10. Preferably, if looking up the target slope the second-row plate piles 10 would be ten feet behind and centered in the space between the first-row plate piles 10.

This pattern is repeated as many times as necessary to cover the entire target slope. Thus, a third row 44 of plate piles 10 would be inserted directly behind the first row along the x-axis, and either 20 feet up- or down-slope along the y-axis. A fourth row 46 of plate piles 10 would be offset from the first row along the x-axis, and 30 feet up- or down-slope along the y-axis. The horizontal width of each row may be varied to accommodate any changes in the width of the target slope.

This four-foot center-to-center placement along the x-axis, and offset 10-foot up- or down-slope placement along the y-axis is preferred for use with colluvial, translational slides of between two and five feet in depth. However, the exact placement of the plate piles can be varied depending on factors such as slope angle, soil type, potential landslide area, and plate 14 width. Once these factors have been taken into account, plate piles 10 may be inserted in any pattern that will induce arching and will increase the shear stability of the slide mass.

Shallow, colluvial, translational slides may occur at any point on the target slope. It is therefore necessary to cover the entire potential or actual landslide area with plate piles 10 to tie down the entire target slope. Once the target slope area and the pattern of plate pile 10 placement have been ascertained it is a relatively simple matter to determine through mathematical calculations the number of plate piles 10 needed to cover the target slope The next step in the method, as shown in FIG. 7, is to transport the pre-determined number of plate piles 10 to the target site.

Next, plate piles 10 are inserted into the soil, preferably in the diamond-shaped lattice pattern, over the entire target slope. Because the plate piles 10 are relatively small and lightweight, they are preferably inserted into the soil using a small backhoe or excavator although any method of pile driving may be used. Piles 12 are preferably inserted approximately three-feet into the bedrock or other solid substrate 30. Plate piles 10 are preferably inserted approximately six inches below ground 32 surface. Given the variations of soil 32 and bedrock 30 depth, these numbers are approximations, only. However, after insertion, plate piles 10 should not be visible above soil 32 surface 32, as shown in FIG. 6.

Various changes and modifications to the presently preferred embodiments will be apparent to those skilled in the art. Such changes and modifications may be made without departing from the spirit and scope of the present invention. The embodiments disclosed herein are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A method for slope stabilization comprising:

identifying a target slope with a potential or actual translational landslide by the presence of colluvial soil, a slope angle of between 1 horizontal to 1 vertical and 3 horizontal to 1 vertical, hummocks, soil fissures, soil cracks, toeing, a pre-existing slide, or soil creep where the target slope has an x-axis and a y-axis;

determining the target slope area by measuring or estimating the area of the target slope;

calculating a sufficient number of plate piles needed to create a series of alternating rows covering the entire target slope area in a diamond-shaped lattice pattern where a first row, and all subsequent odd-numbered rows, contains a plurality of plate piles inserted four feet center-to-center along the x-axis of the target slope, a second row, and all subsequent even-numbered rows, is placed ten feet away from the first row along the y-axis of the target slope, and contains a plurality of plate piles inserted four feet center-to-center along the x-axis of the target slope, and where the even-numbered row plate piles are offset from the odd-numbered row plate piles, and all subsequent even and odd rows continue the calculated pattern to cover the target slope area;

transporting the number of plate piles to the target slope;

inserting a plurality of plate piles into the target area in a series of alternating rows in the calculated diamond-shaped pattern covering the entire slope; and driving at least one of the plate piles below the ground surface into the bedrock.

2. The method of claim 1 wherein each of the plate piles consists of a rectangular plate permanently attached to an angle.

3. The method of claim 1 wherein each of the plate piles consists of a pentahedron plate permanently attached to an angle.

4. The method of claim 2 or 3 wherein each plate has one or more holes.

5. The method of claim 4, further comprising the step of threading a cable through a hole in at least one of the plurality of plate piles.

6. The method of claim 2 or 3 wherein at least one of the plates has a surface area of approximately two feet squared.

7. The method of claim 1 wherein the step of inserting comprises inserting the plurality of plate piles in the target slope in the calculated pattern and inducing soil arching.

* * * * *